United States Patent [19]

Anderson

[11] Patent Number: 4,602,462

[45] Date of Patent: Jul. 29, 1986

[54] BOOM ARTICULATING MECHANISM FOR AERIAL DEVICES

[75] Inventor: Carl M. Anderson, St. Joseph, Mo.

[73] Assignee: Altec Industries, Inc., Birmingham, Ala.

[21] Appl. No.: 672,187

[22] Filed: Nov. 16, 1984

[51] Int. Cl.[4] ..... E04H 12/34

[52] U.S. Cl. ..... 52/119; 52/115; 182/2; 414/680

[58] Field of Search ..... 52/115–119; 182/2; 414/680

[56] References Cited

U.S. PATENT DOCUMENTS

| | | | |
|---|---|---|---|
| 2,881,030 | 4/1959 | Troche | 52/117 X |
| 2,886,187 | 5/1959 | Troche | 52/117 X |
| 4,044,902 | 8/1977 | Eitel | 414/680 |
| 4,069,637 | 1/1978 | Braithwaite | 52/119 X |
| 4,105,151 | 8/1978 | Eltzroth | 414/680 X |
| 4,146,998 | 4/1979 | Johnson | 52/119 X |
| 4,184,802 | 1/1980 | Cook et al. | 414/680 |
| 4,185,427 | 1/1980 | Raymond | 52/115 |
| 4,463,528 | 8/1984 | Johnson | 52/115 X |

FOREIGN PATENT DOCUMENTS

| | | | |
|---|---|---|---|
| 767975 | 9/1967 | Canada | 52/117 |
| 2739355 | 9/1978 | Fed. Rep. of Germany | 52/115 |

*Primary Examiner*—J. Karl Bell

*Attorney, Agent, or Firm*—Kokjer, Kircher, Bradley, Wharton, Bowman & Johnson

[57] ABSTRACT

In a truck mounted overcenter aerial device having an articulating boom assembly, a mechanism for articulating the upper boom relative to the lower boom. A star wheel on the upper boom is acted upon by a pair of linkages powered by hydraulic cylinders mounted on the lower boom. The linkages are pinned at their outer ends to the star wheel so that the upper boom is pivoted in opposite directions when the cylinders are extended and retracted. Each linkage includes pivotally connected links which fold up on the star wheel against stop surfaces as the linkage is extended. The stop surfaces are arranged to control the angular speed of the upper boom and the torque applied to it by the linkages as desired during each angular segment of articulation. The hydraulic control circuit for the cylinders includes counterbalance holding valves which maintain both linkages under tension at all times to avoid any slack or jerkiness when the boom goes overcenter.

17 Claims, 11 Drawing Figures

BOOM ARTICULATING MECHANISM FOR AERIAL DEVICES

BACKGROUND OF THE INVENTION

This invention relates generally to vehicle mounted aerial devices and more particularly to a mechanism which acts to articulate the upper boom of an articulating boom assembly.

Vehicle mounted aerial devices have long been used for a variety of applications such as performing work on utility poles, trimming trees, maintaining street lights, and servicing overhead power and telephone lines. The aerial device normally includes a multiple section boom which can either be an articulating boom or a boom that is extensible and retractable in telescoping fashion. The tip of the upper boom is equipped with a personnel carrying device which is typically a bucket or basket. More than one bucket or basket may be carried on the boom, and the bucket or basket may be large enough to carry more than one worker. Supplemental load lifting devices may also be installed on the boom near the platform in order to provide the aerial device with lifting capabilities. The load lifting device is typically an adjustable jib, a winch, or a combination of both.

Although both the articulating and telescoping booms have advantages, the ability of the articulating aerial device to vary the angle between the upper and lower booms makes it generally more versatile in that it permits workers to reach more areas without the need to move the vehicle or place it in unusual positions such as on sidewalks, in fields, or in roadside ditches. By way of example, workers can be given easy access to the field side of a utility pole by extending the lower boom underneath the power or telephone lines and raising the upper boom until the platform is adjacent to the field side of the pole. In an articulating boom, it is desirable for the upper boom to have as large an arc of articulation as possible and to have the ability to lift the workers and supplemental loads throughout its entire range of articulation. The ability of the upper boom go "overcenter" or past the vertical position is an important attribute in many applications.

At present, there are two types of mechanisms that are in general use to articulate the upper boom of an aerial device. The first type is referred to in the industry as a four bar or scissors linkage. The other type is known as a constant radius mechanism.

The four bar linkage is relatively easy to maintain and is capable of handling large loads through most of its operating range. However, detracting from these advantages are several disadvantages. The moment or torque applied to the load varies rather widely as the angle of articulation changes, and the angular speed is likewise variable with the articulation angle. Near the ends of its travel, the upper boom is moved relatively fast and has a small lifting capacity. Conversely, the upper boom can handle heavy loads but moves slowly near the center of its arc. Four bar linkages are also somewhat limited in the arc through which the upper boom can be moved. If more than about 210°-225° of articulation is needed, four bar linkages are impractical. A final problem is that any looseness in the pivot connections results in play in the linkage when the machine is moved overcenter and the forces applied to the linkage components are suddenly reversed. This causes undesirable jerkiness in the boom operation and applies abrupt shock loads on the components of the four bar linkage.

The constant radius mechanism normally includes a pulley or sprocket on the upper boom and a cable or chain which is drawn around the pulley or sprocket and operated by one or more hydraulic cylinders. In this type of arrangement, there is no change in the angular velocity as the angle of articulation changes because the moment which is applied to the pulley or sprocket is constant. For the same reason, the lifting ability of the machine closely parallels the structural capacity of the boom. Additional advantages are the relatively large angles of articulation that can be achieved (220°-270°) and smoother operation when the machine moves past the overcenter position. However, when a chain and sprocket mechanism is used, there is inevitably some looseness between the sprocket teeth and the links of the chain, especially when they are worn. Thus, at the overcenter position, the sprocket teeth reverse and load the opposite ends of the chain links. Noticeable jerkiness in the boom operation can result, and the wear is greatly accelerated.

Further disadvantages associated with the constant radius mechanism include higher cost of the components and limited lifting capacity caused by the lack of availability of components large enough to provide the necessary strength. Even more importantly, chain and sprocket and cable and pulley devices are notoriously susceptible to wear which can make them dangerous unless they are frequently inspected and regularly serviced and/or replaced. The costs resulting from the high maintenance requirements can be substantial.

SUMMARY OF THE INVENTION

The present invention is directed to an improved articulating mechanism which takes advantage of the desirable features of both the four bar and constant radius mechanism but is not subject to their shortcomings.

In accordance with the invention, a specially constructed star wheel is mounted on the upper boom of a vehicle mounted articulating boom assembly at the pivot connection between the upper and lower booms. Two similarly constructed linkages interact with the star wheel and are powered by hydraulic cylinders to drive the upper boom in opposite directions about its pivot connection with the lower boom. Each linkage includes a pair of links which are pivoted to one another and to the star wheel near its periphery. The star wheel is provided with stop surfaces against which the various links act during different segments of the upper boom articulation. By properly selecting the geometry of the linkages and star wheel, the mechanism can be made to exhibit virtually any desired characteristics during the various segments of boom articulation.

It is an important object of the invention to provide a mechanism for articulating the upper boom of an aerial device in a manner to accurately control the angular velocity and torque throughout the angular range of the boom. It is a particularly noteworthy feature of the invention that the mechanism can be custom tailored for the particular jobs that are to be performed by the aerial device. For example, if the machine requires a relativley fast angular speed during one angular range, a slower speed but more lifting capacity during another angular range and a nearly uniform speed and torque during other ranges, the star wheel and links can be arranged to meet all of these requirements.

Another object of the invention is to provide a mechanism which has the ability to articulate the upper boom through an arc approaching a full 360°. In addition, the folding linkages allow the use of cylinders having a relatively short stroke while still achieving a large angle of articulation.

A further object of the invention is to provide a mechanism of the character described which eliminates play in the connections between the components and the jerky boom movement and excessive wear that can result therefrom. The linkages are directly connected to the star wheel rather than transmitting torque through a chain and sprocket or cable and pulley arrangement which can slip or create lost motion, especially when the boom goes over center. At the same time, the cylinders positively maintain both linkage under tension at all times so that there is no free play at the over center position or during any other stage of operation.

An additional object of the invention is to provide a mechanism of the character described which is arranged to prevent the cylinders from stressing the boom or other parts of the machine when the boom is stored in the vehicle for transport.

A still further object of the invention is to provide a mechanism of the character described having components which are simple and low in cost, which are durable and not subject to undue wear, and which require only minimal maintenance.

Other and further objects of the invention, together with the features of novelty appurtenant thereto, will appear in the course of the following description.

DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
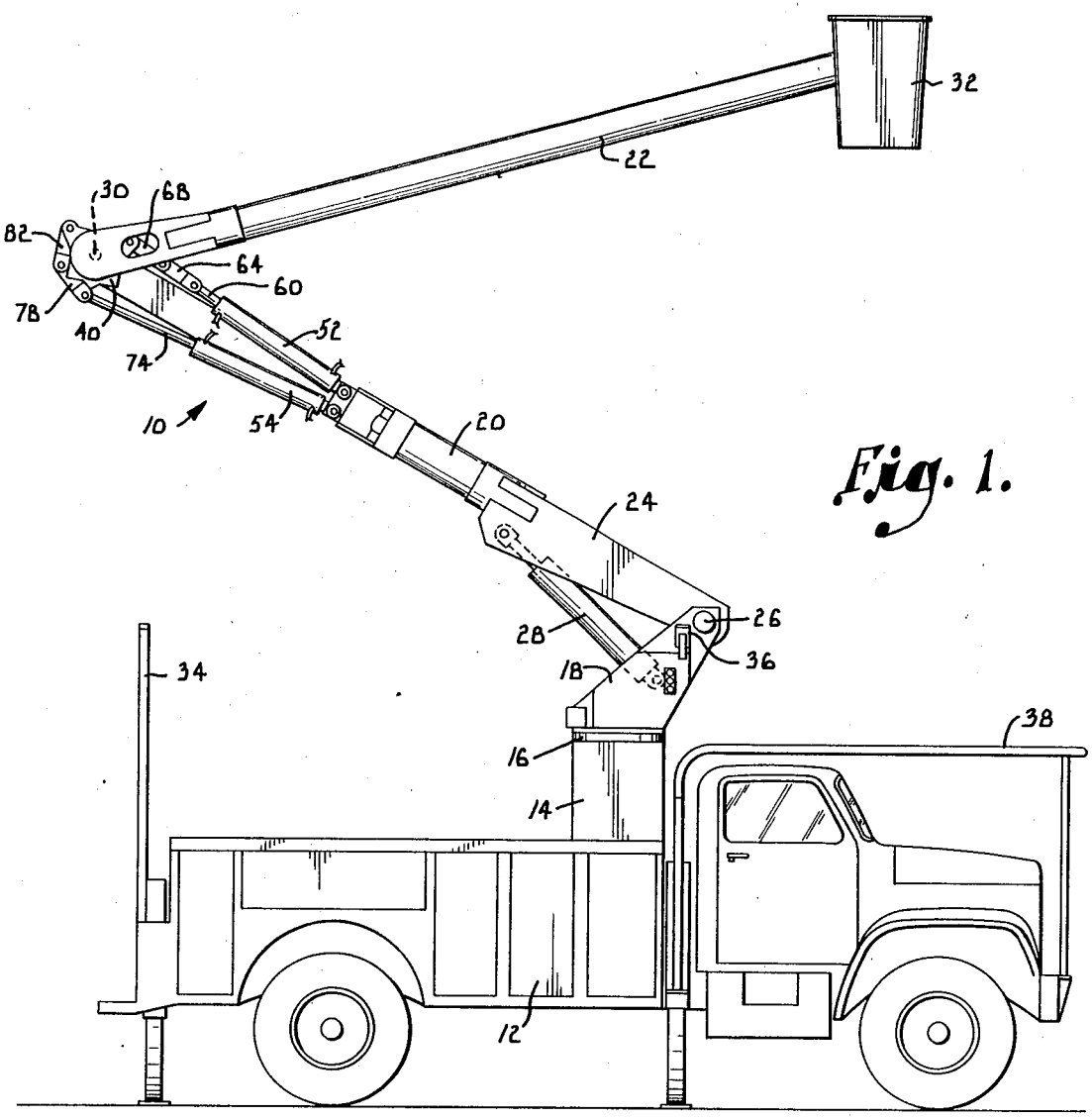
FIG. 1 is a side elevational view showing a truck mounted aerial device equipped with a boom articulating mechanism constructed according to a preferred embodiment of the present invention.

Referring now to the drawing in more detail and initially to FIG. 1 in particular, numeral 10 generally designates an articulating aerial device which is mounted in the bed of a utility truck 12. A stationary pedestal 14 is mounted in the truck bed immediately behind the cab. Mounted for rotation on pedestal 14 is a turntable 16 which carries a turret 18. The turntable can be rotated by a drive motor (not shown) about a vertical axis or rotation in order to rotate the aerial device 10 to various positions.

The aerial device includes an articulating boom assembly formed by a lower boom 20 and an upper boom 22. The bottom end of the lower boom 20 includes a large bracket 24 which is pivotally connected with the turret 18 by a horizontal pivot pin 26. Boom 20 may be pivoted up and down about the axis of the lower boom pin 26 by a hydraulic cylinder 28 having its base end pivoted to the turret 18 and its rod end pivoted to the bracket 24.

The top end of the lower boom 20 is pivotally connected with the bottom end of the upper boom 22 at an articulated joint. A horizontal pin 30 forms a pivot axis about which the upper boom can be articulated relative to the lower boom. Preferably, the upper boom can pivot through a large angle of articulation relative to the lower boom. In a preferred form of the present invention, this angle of articulation is well beyond 180° and may approach 360°. At its top end or tip, the upper boom 22 carries one or more buckets 32. A conventional leveling system (not shown) acts to maintain the buckets level at all positions of the boom assembly.

The aerial device 10 has a storage position in which the lower and upper booms 20 and 22 are side by side and horizontal. In the storage position, the lower boom 20 is lowered onto a frame 34 mounted on the truck 12. The upper boom 22 is lowered to a zero angle of articulation and rests on a boom rest or cradle 36 mounted on one side of the turret 18. A rack 38 extends over the top of the cab and provides a convenient platform from which workers can enter or exit from the buckets 32.

Figure 2:
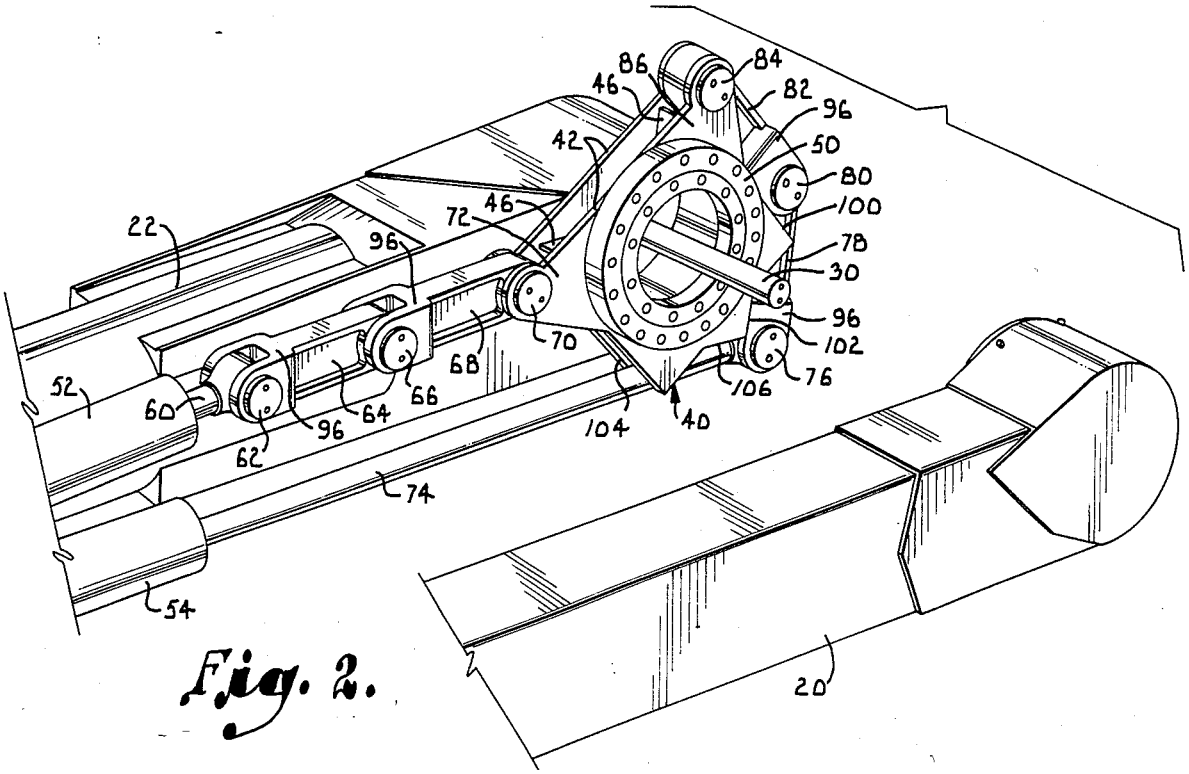
FIG. 2 is a fragmentary, exploded perspective view on an enlarged scale showing the articulating mechanism and the booms of which it acts.

The present invention is directed to a mechanism which functions to articulate the upper boom 22 in opposite directions about the horizontal pin 30. The mechanism includes a star wheel 40. As best shown in FIG. 2, the star wheel 40 is formed by a pair of identical, irregularly shaped plates 42, one of which is welded or otherwise rigidly secured to the bottom end of the upper boom 22. The star wheel 40 is generally centered on the pin 30 and rotates with the upper boom about the axis of the pin.

Figure 5:
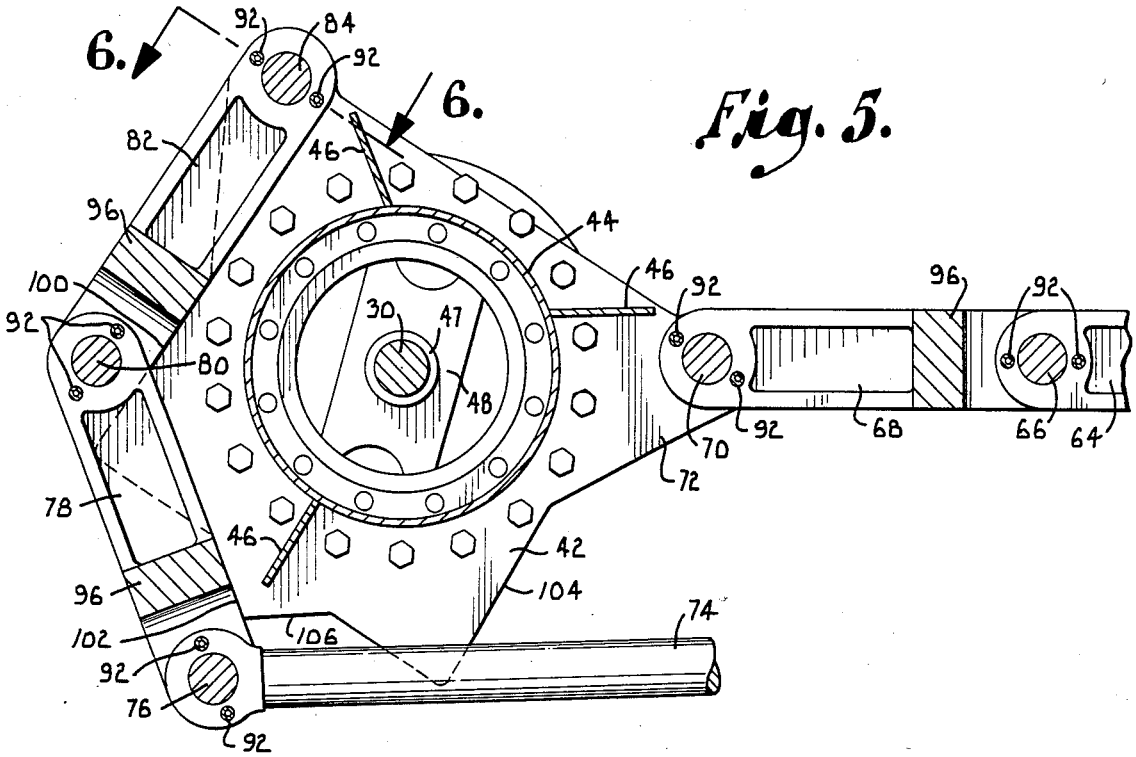
FIG. 5 is a fragmentary sectional view on an enlarged scale taken generally along line 5—5 of FIG. 4 in the direction of the arrows.

The two plates 42 are parallel to one another and are rigidly connected by a large sleeve 44 (see FIG. 5) and three small plates 46 which are spaced apart around the circumference of the sleeve. The pivot pin 30 is received at its opposite ends in bushings 47 which are mounted in rigid brackets 48 secured in the upper and lower booms. The outer race of a ball bearing 50 is bolted to one of the plates 42, and the inner race of the bearing is bolted to the top end of the lower boom 20. The bearing 50 is concentric with pin 30 to permit the upper boom to articulate relative to the lower boom about the axis of pin 30.

Upper and lower hydraulic cylinders 52 and 54 have base ends which are pivotally connected with the lower boom 20 by respective pivot pins 56 and 58. The upper cylinder 52 has an extensible and retractable piston rod 60 which is connected with a linkage formed by a pair of rigid links pivotally connected end to end. Rod 60 is pivoted at 62 to the inner end of a rigid link 64. The outer end of link 64 is pivotally connected with the inner end of another rigid link 68. The outer end of link 68 is pivotally connected at 70 with a node 72 projecting from the periphery of the star wheel 40.

The lower cylinder 54 operates a similar linkage formed by a pair of rigid links pivotally connected end to end. Cylinder 54 has a piston rod 74 which is pivotally connected at 76 with the inner end of a rigid link 78. The outer end of link 78 is pivotally connected at 80 with the inner end of another rigid link 82. The outer end of link 82 is pivotally connected at 84 with a node 86 projecting from the periphery of the star wheel 40. Pivot connections 70 and 84 are offset from one another and are outboard of pin 30.

Figure 6:
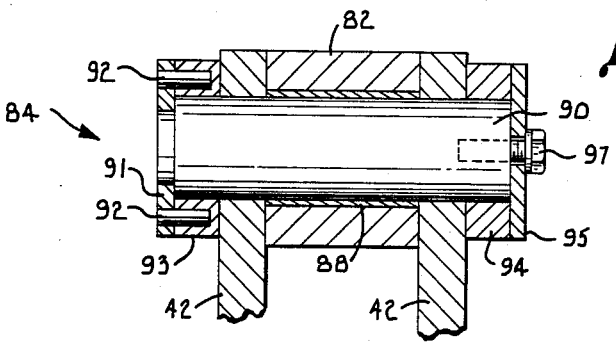
FIG. 6 is a fragmentary sectional view on an enlarged scale taken generally along line 6—6 of FIG. 5 in the direction of the arrows.

All of the aforementioned pivot connections are made in a similar manner which can best be understood by referring to the pivot connection 84 shown in FIG. 6. The end of link 82 is fitted closely between the two plates 42 of the star wheel. A bushing 88 is fitted in an opening formed through the end of link 82 in alignment with similar openings formed in the node portions of the plates 42. A horizontal pin 90 expands through the bushing 88 and the openings in the star wheel plates. The pivot pin 90 has a lug 91 on one end which receives a pair of roll pins 92. The roll pins also extend into a bushing 93 which encircles the end of pin 90. Another bushing 94 encircles the opposite end of pin 90 and is held against one of the plates 42 by a disk 95. A pair of cap screws 97 are extended through disk 95 and threaded into the end of pin 90 to complete the pivot joint.

The remaining pivot connections are made in a similar manner. As best shown in FIG. 2, each link has an enlarged U-shaped clevis 96 on one end which embraces and is pinned to the end of the adjacent link (or the adjacent piston rod in the case of the inner links 64 and 78). All of the aforementioned pivot connections are parallel to one another and to pin 30.

The periphery of the star wheel 40 is provided with a plurality of stop surfaces which interact with the links during various segments of boom articulation. Numeral 100 designates a stop surface which is engaged by link 82. Another and somewhat shorter stop surface 102 is engaged by link 78 of the lower linkage. Additional stop surfaces 104 and 106 are formed on the periphery of the star wheel to engage the respective links 68 and 64 of the upper linkage. It should be noted that all of the clevices 96 are wide enough to engage the stop surfaces formed on the edges of the star wheel plates 42, while the remainder of each link is thin enough to pass between the star wheel plates. Each stop surface is strategically located and oriented to achieve particular operational characteristics of the boom assembly during the various segments of articulation, as will be explained more fully. The stop surfaces may have different locations and configurations other than the straight configurations shown in the drawings, and it is noted that they restrain the links from moving toward the pivot pin 30 beyond the limiting position established by the stop surfaces, thereby keeping the centerline of each link a predetermined distance from pin 30.

Figure 11:
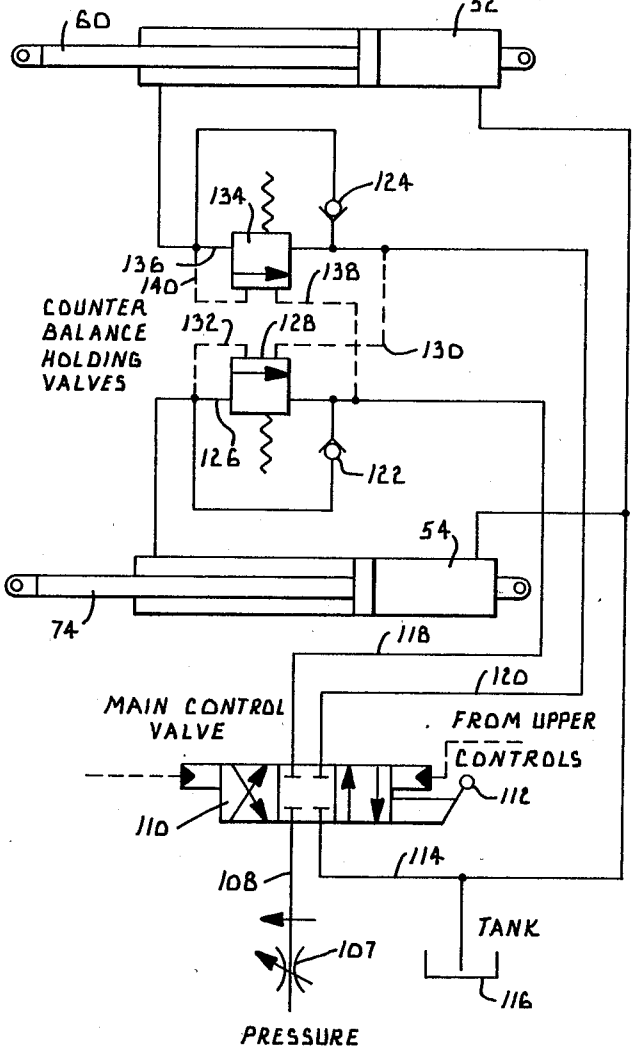
FIG. 11 is a schematic diagram of the hydraulic circuit which controls the hydraulic cylinders of the boom articulating mechanism.

FIG. 11 shows the hydraulic circuit which is used to control the hydraulic cylinders 52 and 54. The circuit includes a pump (not shown) which supplies hydraulic fluid under pressure through an adjustable flow control valve 107 to a pressure line 108 leading to a main control valve 110. The control valve is shown in the neutral position in FIG. 11 and can be shifted in both directions from the neutral position, both by a control handle 112 located on the valve 110 and by upper controls located in the buckets 32 and operable via a conventional remote control system to effect shifting of the valve 110. Also connected with valve 110 is a relief line 114 which leads to a fluid reservoir 116. The base ends of the hydraulic cylinders 52 and 54 are connected with the reservoir 116.

The opposite side of valve 110 connects with lines 118 and 120. Line 118 connects with the rod or retract end of cylinder 54 through a check valve 122. Line 120 similarly connects with the rod or retract end of cylinder 52 through a check valve 124. The check valve 122 can be bypassed via line 126 which is equipped with a pilot operated counter balance holding valve 128. Valve 128 is normally closed but is opened when sufficient pressure is applied to a pilot line 130 which connects with line 120. Valve 128 can also be opened by a second pilot line 132 which prevents excessive pressure from being applied to the rod or retract end of cylinder 54.

Another pilot operated counter balance holding valve 134 operates in a line 136 which bypasses check valve 124. Valve 134 is normally closed but opens when sufficient pressure is applied to a pilot line 138 extending from line 118. Valve 134 can also be opened by another pilot line 140 which connects with the rod or retract end of cylinder 52.

In operation, the aerial device 10 is used to properly position one or more workers so that they can perform various tasks such as trimming trees, performing work on utility poles, maintaining street lights, and servicing overhead power or telephone lines. The worker or workers ordinarily enter the basket 32 while the boom assembly is in the storage position shown in FIGS. 3 and 4. In this position, the booms 20 and 22 are located side by side, with the lower boom 20 resting on frame 34 and the upper boom 22 resting on the cradle or boom rest 36. The bucket 32 is then located immediately above rack 38, and the worker or workers can easily enter the bucket from the rack. Alternatively, the boom assembly can be moved overcenter to the position shown in FIG. 10. Normally, the lower boom 20 will be raised somewhat off of the frame 34, and the upper boom 22 can then be articulated overcenter to position the bucket 32 near the ground so that the workers can easily enter the bucket from ground level. In any event, once the workers have entered the bucket, the turret 18 is rotated to the desired rotative position, and cylinder 28 is extended as desired to raise the lower boom 20 to the proper elevation.

The mechanism of the present invention serves to articulate the upper boom 22 relative to the lower boom 20 about the horizontal pivot pin 30. The upper boom can be pivoted from the storage position of FIG. 3 to the 45° position of FIG. 7 by retracting cylinder 54 while simultaneously extending cylinder 52. This is accomplished by shifting the main control valve 110 to the left from the neutral positon shown in FIG. 11. Then, the supply line 108 is connected with line 118 to apply fluid under pressure thereto. The fluid is able to pass the check valve 122 and enter the rod end of cylinder 54 in order to retract its cylinder rod 74. The pressure in line 118 is transmitted through pilot line 138 to the counter balance holding valve 134. When the pressure level in line 138 is sufficiently high, valve 134 is moved to the open position to connect the rod end of cylinder 52 with line 120. Since line 120 is connected through valve 110 with the tank line 114, fluid is relieved from the rod end of cylinder 52 so that its rod 60 can extend as the other cylinder rod 74 is retracted by the application of positive fluid pressure.

Figure 3:
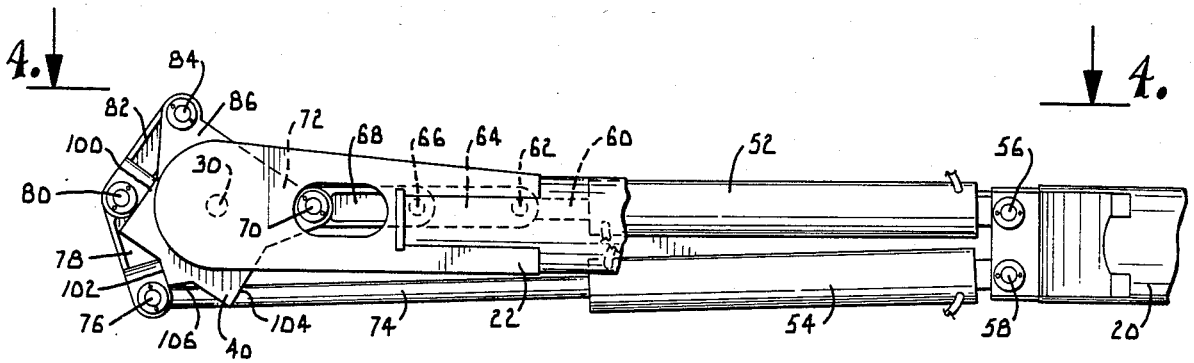
FIG. 3 is a fragmentary side elevational view of the articulating mechanism and booms, with the upper boom located side by side with the lower boom in the storage position of the boom assembly.
Figure 4:
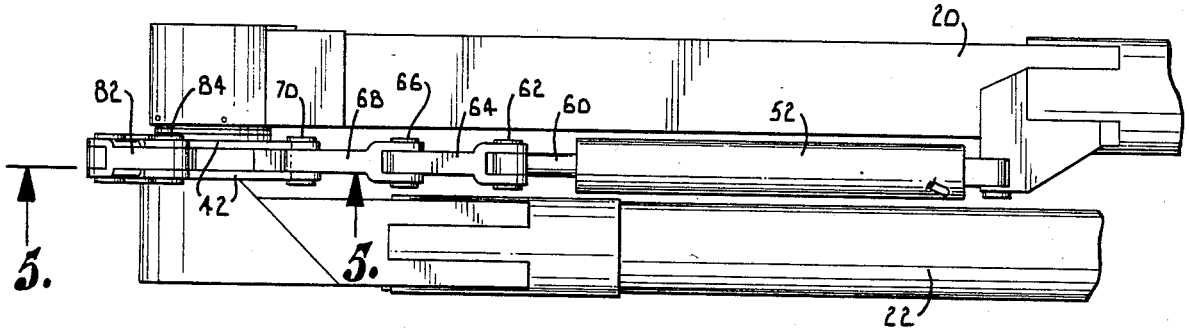
FIG. 4 is a fragmentary top plan view taken generally along line 4—4 of FIG. 3 in the direction of the arrows.
Figure 7:
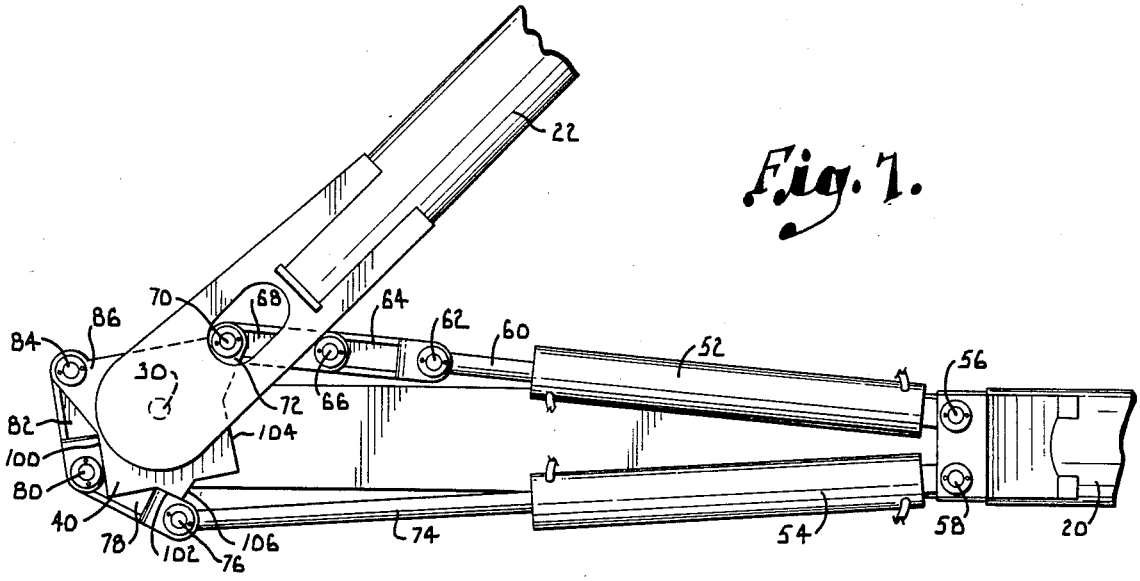
FIG. 7 is a fragmentary side elevational view similar to FIG. 3, but showing the upper boom pivoted to an angle of articulation of about 45° relative to the lower boom.

As rod 74 is thus retracted to pivot the upper boom 22 from the position of FIG. 3 to the position of FIG. 7, the load applied to boom 22 caused by its weight, the weight of the workers and equipment in the bucket 32 and any supplemental loads applied to the upper boom is borne by the lower linkage which includes links 78 and 82. During this segment of the upper boom articulation, link 82 is engaged and held rigidly against stop surface 100, while link 78 is similarly held rigidly against stop surface 102. Links 78 and 82 are folded generally around the star wheel 40 and act essentially as if they were rigid parts of the star wheel. Consequently, the force applied by cylinder 54 is directly in line with pivot connection 76 during this segment of boom articulation.

The torque or moment force applied to the star wheel 40 is dependent upon the force applied by cylinder 54 and the moment arm about which the cylinder acts (relative to pin 30). The moment arm depends upon the position of pivot connection 76 which is in turn determined by the location and orientation of the stop surface 102 against which link 78 is held. If a relatively long moment arm is desired to achieve a relatively high torque during this segment of boom articulation, the stop surface 102 can be located and oriented to provide a maximum moment arm. Conversely, if a relatively high angular speed is desired during this segment of articulation, the stop surface 102 can be located and oriented such that the angular speed is maximized. Virtually any other desired combination of torque and angular speed can be achieved for this and all other segments of the boom articulation.

Figure 8:
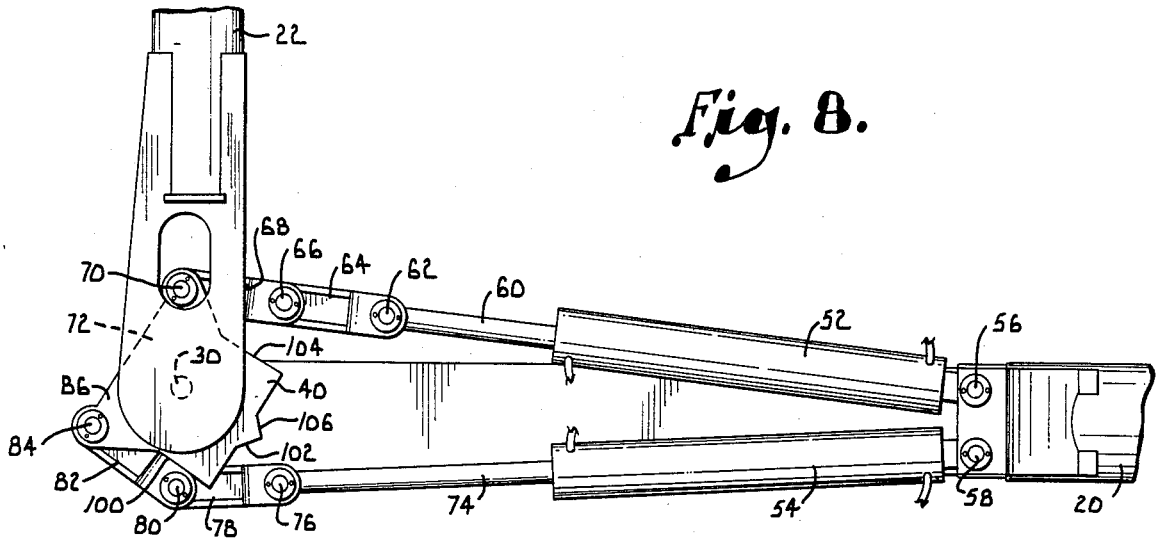
FIG. 8 is a fragmentary side elevational view similar to FIG. 7, but showing the upper boom pivoted to an angle of articulation of about 90° relative to the lower boom.

Continued retraction of cylinder 54 moves boom 22 from the position of FIG. 7 toward the positon of FIG. 8. As the star wheel 40 continues to turn, link 78 releases from stop surface 102, and the force applied by cylinder 54 is thereafter applied directly in line with pivot connection 80 which connects links 78 and 82. Link 82 remains rigidly against stop surface 100 and continues to function as if it were a rigid part of the star wheel 40. During the segment of articulation after link 78 releases from surface 102, the torque and angular velocity are determined by the location of pivot connection 80 which is turn dependent upon the location and orientation of the stop surface 100.

Figure 9:
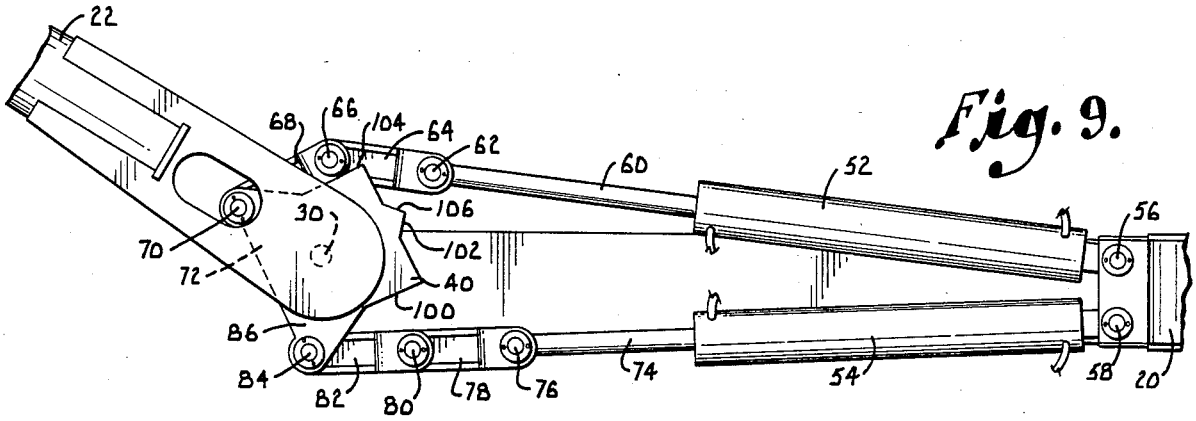
FIG. 9 is a fragmentary side elevational view similar to FIG. 8, but showing the upper boom pivoted to an angle of articulation of about 150° relative to the lower boom.

As cylinder 54 continues to retract, boom 22 continues to pivot in a counterclockwise direction about pin 30 toward the position of FIG. 9. As soon as link 82 releases from stop surface 100, the force applied by cylinder 54 is thereafter applied in line with pivot connection 84.

As cylinder 52 extends from the position of FIG. 8 to the position of FIG. 9, link 68 comes into contact with stop surface 104. Prior to this time, the upper linkage had been maintained in a straight condition, and the force applied by cylinder 52 had been directly in line with pivot connection 70 because the upper linkage was effectively an extension of the cylinder. However, when rod 60 extends beyond the position at which link 68 engages stop surface 104, the upper linkage folds about pivot connection 66, and the force applied by cylinder 52 is thereafter directly in line with pivot connection 66. Stop surface 104 can be located and oriented to achieve the desired torque and angular velocity during the segment of boom articulation controlled by the position of connection 66.

Figure 10:
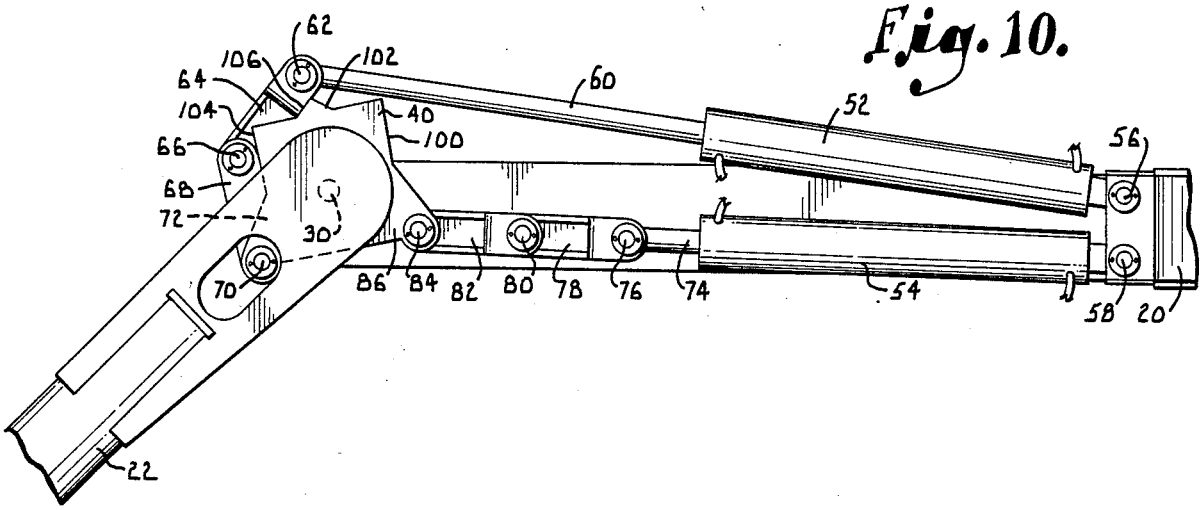
FIG. 10 is a fragmentary side elevational view similar to FIG. 9, but showing the upper boom pivoted to an angle of articulation of about 225° relative to the lower boom.

As rod 74 continues to retract and rod 60 continues to extend, boom 22 is pivoted from the position of FIG. 9 toward the position of FIG. 10. During this segment of boom articulation, the upper boom 22 moves past an angle of articulation of 180° relative to the lower boom. Once the star wheel 40 has turned far enough to bring link 64 into contact with stop surface 106, link 64 begins to fold around the star wheel about its pivot connection 62 with the cylinder rod 60. Once link 64 begins to fold, the force applied by cylinder 52 is thereafter directly in line with pivot connection 62, and the location of connection 62 determines the angular velocity and torque during the applicable segment of articulation.

In the position of FIG. 10, the angle of articulation of boom 22 is about 245° which is adequate for many applications of the aerial device 10. However, it is to be noted that the linkage of the present invention can be arranged to achieve much greater articulation of the upper boom, and angles approaching a full 360° can be achieved.

The upper boom 22 can be pivoted in the reverse direction by retracting cylinder 60 and simultaneously extending cylinder 74. To accomplish this, valve 112 is shifted fully to the right, and the pressure line 108 is then connected through valve 110 with line 120. Line 118 is connected with line 114. The fluid pressure applied to line 120 passes through check valve 124 to the rod end of cylinder 52, thus retracting rod 60. At the same time, the pressure in line 120 is transmitted through pilot line 130 to holding valve 128 and pilot line 132 is subjected to pressure caused by the mechanical force pulling on rod 74. When the pilot lines open the holding valve 128, the hydraulic fluid in the rod end of cylinder 54 is relieved through the holding valve 128 and the main control valve 110.

Because the lower boom 20 is normally raised at least somewhat during operation of the aerial device, the upper boom 22 normally moves overcenter or past vertical at some point between the positions shown in FIGS. 8 and 9. As the boom moves over center, the load applied to the articulation mechanism shifts from one of the linkages to the other linkage. Immediately prior to reaching the overcenter position, one of the hydraulic cylinders is loaded and the other is not, depending upon the direction of movement of the boom. The counter balance holding valves 128 and 134 maintain fluid pressure in the rod end of the none working cylinder so that it can readily take over the load without jerkiness or other adverse consequences. Because the pilot lines 130 and 138 are connected with the main fluid supply lines 120 and 118, the holding valve of the non-loaded cylinder is maintained under greatest pressure when the load is the least and under the least pressure when the load is the greatest. For example, when cylinder 54 is heavily loaded, line 118 is maintained at a high pressure, and holding valve 134 is subjected to maximum pilot pressure through line 138. Consequently, the pressure applied to the rod end of cylinder 52 is relieved to the greatest extent. Conversely, if cylinder 54 is loaded only lightly, the pressure in line 118 is relatively low, and the holding valve 134 maintains a relatively high pressure in the rod end of cylinder 52.

At the time the upper boom 22 is about to go overcenter, the load is relatively light since bucket 32 is located immediatley above pin 32. The light loading of the upper boom results in the nonloaded cylinder being maintained under relatively great fluid pressure by its holding valve, and as previously nonloaded cylinder takes over the load as the overcenter position is passed, it is able to do so easily because of the already high fluid pressure applied to its rod end. The overall result is that there is no significant jerking that occurs as the boom moves overcenter, and the boom is able to operate in a smooth manner without applying shock loads to the articulating drive mechanism.

Since the linkages are directly connected to the star wheel 40 and the hydraulic cylinders 52 and 54 apply tensile forces to both of the linkages at all times, there is no lost motion or undesirable play encountered in transmitting torque from the drive mechanism to the upper boom, and there is no slack in either linkage that must be taken up when the boom move overcenter. As previously indicated, the upper boom 22 normally goes overcenter between the positions shown in FIGS. 8 and 9, and it is noted that the two linkages are approximately equally extended. Therefore, there is no abrupt change in the moment arm at the time the machine goes overcenter, and there is thus no abrupt change in the angular velocity of the boom or the moment force applied to it as the overcenter position is passed.

Because the links progressively fold up around the star wheel 40 about their pivot connections as the corresponding cylinder is extended, it is possible to customize the articulation mechanism such that it exhibits virtually any desired characteristics during the various segments of articulation. By properly locating and orienting the stop surfaces of the star wheel, the articulating mechanism of the present invention can be made to move the upper boom at a relatively fast angular speed during some segments of articulation and at slower speeds but with greater torque application during other segments of articulation. This is to be contrasted with the constant radius type of mechanism which moves the boom at a constant angular speed at all positions and applies the same torque at all positions. It should be noted that it is generally desirable not to abruptly accelerate the boom as it moves past the overcenter position, so the moment arms should be selected such that they are approximately equal on opposite sides of the overcenter position.

The folding up of the linkages as they extend around the star wheel permits the cylinders 52 and 54 to have a relatively short stroke and to achieve a large angle of articulation with only a small amount of cylinder travel. In order to achieve the same articulation and lifting capacity as the device of the present invention, a constant radius device would require a cylinder stroke between 1½ and 2 times as long as the stroke of cylinders 52 and 54. At the same time, the components of the linkage are heavy duty parts which are readily able to withstand the loads that are encountered and which do not require the extensive maintenance and frequent replacement associated with constant radius devices.

When the boom assembly is lowered to the storage position shown in FIG. 3, the upper boom 22 is beside and parallel to the lower boom 20, and the cylinders 52 and 54 are generally parallel to the booms. The linkage formed by links 64 and 68 is in a straight condition in which the pivot connections 62, 66 and 70 define a straight line which is directly in line with the pivot pin 30. Therefore, cylinder 52 does not apply any torque to the star wheel 40, and the upper boom 22 is able to rest freely on the boom rest 36 without being subjected to any stresses caused by undue force applied by cylinder 52 during transport.

Although good results can be obtained by providing each linkage with two rigid links, more than two links can be used in one or both linkages. The links can have virtually any desired length and can be curved links rather than the straight links shown in the drawings. The stop surfaces on the star wheel can likewise be curved, convoluted or otherwise shaped as desired to permit the mechanism to be "custom tailored" to the particular conditions the machine is expected to encounter in service.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having this described the invention, I claim:

1. A mechanism for articulating an aerial boom assembly having a pair of booms connected for relative movement about a pivot axis, said mechanism comprising:

first and second linkages each having at least one rigid link said one link in each linkage being pivotally connected at one end with one of the booms at a location outboard of said pivot axis and at the other end with the remainder of the linkage;

power means for applying a tensile force to each linkage, said power means being selectively operable to retract each linkage, while concurrently extending the other linkage to thereby pivot said one boom about said pivot axis;

a first stop surface on said one boom located and oriented to engage said one link in the first linkage in a manner to effect folding of said one link about said other end thereof when the first linkage is extended beyond a predetermined position, whereby the force applied to said first linkage by said power means is substantially in line with said one end of said one link when said first linkage is retracted from said predetermined position and substantially in line with said other end of said one link when said first linkage is extended from said predetermined position; and a second stop surface on said one boom located and oriented to engage said one link in the second linkage in a manner to effect folding of said one link about said other end thereof when the second linkage is extended beyond a preselected position, whereby the force applied to said second linkage by said power means is substantially in line with said one end of said one link when the second linkage is retracted from said preselected position and substantially in line with said other end of said one link when said second linkage is extended from said preselected position.

2. The mechanism of claim 1, including a wheel member mounted on said one boom for rotation therewith about said pivot axis, said wheel member having a periphery presenting said first and second stop surfaces thereon.

3. The mechanism of claim 1, wherein:

the boom assembly has a storage position wherein the booms are generally side by side; and said first linkage is in a generally straight condition and is substantially in line with said pivot axis in the storage position of the boom assembly.

4. The mechanism of claim 1, wherein said power means includes:

a first extensible and retractable power cylinder having a base end mounted on the other boom and a rod end connected with said first linkage;

a second extensible and retractable power cylinder having a base end mounted on the other boom and a rod end connected with said second linkage; and means for retracting each cylinder while concurrently extending the other cylinder.

5. The mechanism of claim 4, including:

a link in each linkage adjacent said one end thereof and pivotally connected thereto generally end to end;

means for pivotally connecting said adjacent link of the first linkage at one end thereof with the rod end of said first cylinder;

means for pivotally connecting said adjacent link of the second linkage at one end thereof with the rod end of said second cylinder;

a third stop surface on said one boom located and oriented to engage said adjacent link in the first linkage in a manner to effect folding of said adjacent link about said one end thereof when the first linkage is extended beyond a second predetermined position, whereby the force applied by said first cylinder to said first linkage is substantially in line with said one end of said adjacent link when said first linkage is extended beyond said second predetermined position; and a fourth stop surface on said one boom located and oriented to engage said adjacent link in the second linkage in a manner to effect folding of said adjacent link about said one end thereof when the second linkage is extended beyond a second preselected position, whereby the force applied by said second cylinder to said second linkage is substantially in line with said one end of said adjacent link when said second linkage is extended beyond said second preselected position.

6. The mechanism of claim 5, wherein:

the boom assembly has a storage position wherein the booms are generally side by side; and said one end of said one link in the first linkage, said one end of said adjacent link in the first linkage, the pivot connection between said one link and said adjacent link in the first linkage and said pivot axis define a substantially straight line in the storage position of the boom assembly.

7. The mechanism of claim 5, including a wheel member mounted on said one boom for rotation therewith about said pivot axis, said wheel member having a periphery presenting all of said stop surfaces thereon.

8. The mechanism of claim 1, wherein the booms are pivotal relative to one another through an arc greater than 180°.

9. In a vehicle mounted aerial device having a boom assembly which includes a lower boom mounted for rotation and for up and down pivotal movement on the vehicle and an upper boom connected with the lower boom for articulating movement about a generally horizontal pivot axis, the improvement comprising:

a wheel member mounted on the upper boom and rotatable therewith about said pivot axis;

first and second linkages each having a plurality of rigid links pivoted together generally end to end, each linkage including an inner link and an outer link and each outer link having one end pivotally connected with said wheel member outboard of said pivot axis;

first and second extensible and retractable power cylinders each having a base end connected with the lower boom and a rod end opposite said base end, said inner links of the first and second linkages having inner ends connected with the rod ends of the respective first and second cylinders;

means for retracting each cylinder while concurrently extending the other cylinder to pivot the upper boom in opposite directions about said pivot axis while maintaining both linkages under continuous tension;

a plurality of stop surfaces on said wheel member against which the links of said first linkage are progressively engaged in a manner to effect folding of the links on said wheel member as the first linkage is progressively extended and against which the links of said second linkage are progressively engaged in a manner to effect folding of the links on said wheel member as the second linkage is progressively extended, thereby controlling the torque applied to said wheel member by said cylinders in accordance with the locations and orientations of said stop surfaces.

10. The improvement of claim 9, wherein:

the boom assembly has a storage position wherein the upper and lower booms are generally side by side; and said pivot axis and the pivot connections between the links of said first linkage define a generally straight line when the boom assembly is in the storage position.

11. The improvement of claim 9, wherein said retracting means includes:

means for applying fluid under pressure to each cylinder in a manner to retract the cylinder; and means for relieving the fluid pressure from the other cylinder to permit same to extend concurrently with retraction of the cylinder subject to fluid under pressure.

12. The improvement of claim 9, wherein the upper boom is movable about said pivot axis through an arc greater than 180°.

13. An articulating boom assembly for a vehicle mounted aerial device, said boom assembly comprising:

a lower boom mounted on the vehicle for rotation about a generally vertical rotational axis and for up and down pivotal movement;

an upper boom connected with said lower boom for articulating movement relative thereto about a generally horizontal pivot axis;

a first linkage including at least first and second rigid links pivotally connected generally end to end at a first pivot connection, said first link having an outer end pivotally connected with said upper boom at a location outboard of said pivot axis;

a first extensible and retractable power cylinder having a base end connected to the lower boom and a rod end pivotally connected with said first linkage at an inner end thereof, said cylinder applying a tensile force to said first linkage;

a first stop surface on said upper boom located and oriented to engage said first link and hold same rigidly against said first surface when the extension of said first cylinder exceeds a first predetermined magnitude, and to release from the first link when the extension of said first cylinder is less than said first magnitude;

a second stop surface on said upper boom located and oriented to engage said second link and hold same rigidly against said second surface when the extension of said first cylinder exceeds a second predetermined magnitude greater that said first magnitude, and to release from said second link when the extension of said first cylinder is less than said second magnitude, whereby the force applied to said first linkage by said first cylinder is substantially in line with said outer end of the first link when the first cylinder extension is less than said first magnitude, substantially in line with said first pivot connection when the first cylinder extension is between said first and second magnitudes and substantially in line with said inner end of the first linkage when the first cylinder extension exceeds said second magnitude;

a second linkage including at least third and fourth rigid links pivotally connected generally end to end at a second pivot connection, said third link having an outer end pivotally connected with said upper boom at a location outboard of said pivot axis;

a second extensible and retractable power cylinder having a base end connected to the lower boom and a rod end pivotally connected with said second linkage at an inner end thereof, said second cylinder applying a tensile force to said second linkage;

a third stop surface on said upper boom located and oriented to engage said third link and hold same rigidly against said third surface when the extension of said second cylinder exceeds a third predetermined magnitude, and to release from the third link when the extension of said second cylinder is less than said third magnitude;

a fourth stop surface on said upper boom located and oriented to engage said fourth link and hold same rigidly against said fourth surface when the extension of said second cylinder exceeds a fourth predetermined magnitude greater than said third magnitude, and to release from said fourth link when the extension of said second cylinder is less than said fourth magnitude, whereby the force applied to said second linkage by said second cylinder is substantially in line with said outer end of the third link when the second cylinder extension is less than said third magnitude, substantially in line with said second pivot connection when the second cylinder extension is between said third and fourth magnitudes and substantially in line with said inner end of the second linkage when the second cylinder extension exceeds said fourth magnitude; and means for effecting retraction of each cylinder and concurrent extension of the other cylinder to pivot said upper boom in opposite directions about said pivot axis.

14. The invention of claim 13, including a wheel member mounted on the upper boom for rotation therewith about said pivot axis, said stop surfaces being presented on said wheel member.

15. The invention of claim 14, wherein said stop surfaces are located and oriented to effect progressive folding of the first linkage generally around said wheel member as said first cylinder progressively extends and progressive unfolding of the first linkage from the wheel member as said first cylinder progressively retracts, and to effect progressive folding of the second linkage generally around said wheel member as said second cylinder progressively extends and progressive unfolding of the second linkage from the wheel member as said second cylinder progressively retracts.

16. The invention of claim 13, wherein:

the boom assembly has a storage position wherein said upper and lower booms are generally side by side; and said outer end of the first link, the pivot connection between said first and second links, said inner end of the first linkage and said pivot axis define a substantially straight line in the storage position of the boom assembly.

17. The invention of claim 13, where in said upper boom can pivot about said pivot axis through an arc greater than 180°.

* * * * *